United States Patent [19]

Bieringer

[11] 4,136,779

[45] Jan. 30, 1979

[54] AMPULE SCORE LINE DETECTION

[75] Inventor: Robert J. Bieringer, Toledo, Ohio

[73] Assignee: Owens-Illinois, Inc., Toledo, Ohio

[21] Appl. No.: 863,200

[22] Filed: Dec. 22, 1977

[51] Int. Cl.[2] ..... B07C 5/00; B07C 5/342

[52] U.S. Cl. ..... 209/524; 209/525; 209/538; 209/579; 250/223 B; 356/446

[58] Field of Search ..... 209/73, 111.5, 111.7 R; 250/223 B, 224; 356/196, 198, 210, 237, 240; 215/32, 250, 253

[56] References Cited

U.S. PATENT DOCUMENTS

| | | | |
|---|---|---|---|
| 2,354,628 | 7/1944 | Whitesell | 356/237 |
| 3,154,230 | 10/1964 | Langloys | 215/32 X |
| 3,355,014 | 11/1967 | Howles | 209/111.7 R |
| 3,430,055 | 2/1969 | Metzger | 356/237 |
| 3,489,909 | 1/1970 | Martel | 356/210 X |
| 3,604,940 | 9/1971 | Matthews | 356/196 |
| 3,695,771 | 10/1972 | Bardos | 356/210 |
| 3,834,822 | 9/1974 | Stapleton et al. | 356/210 X |

*Primary Examiner*—Joseph J. Rolla

*Attorney, Agent, or Firm*—David L. Fehrman; Myron E. Click; David H. Wilson

[57] ABSTRACT

This invention relates to the inspection of glass ampules to determine whether or not a complete score line is present. A laser beam is directed to the point on the ampule where a score line would be located. The laser beam is reflected in a diffuse or specular fashion depending upon whether or not a score line is present. By detecting the amount of light which is diffusely reflected in a particular direction, determination of the presence of a score line is possible. The same inspection may be utiiized to determine whether the constriction on an ampule is of the proper diameter.

21 Claims, 6 Drawing Figures

FIG. 2
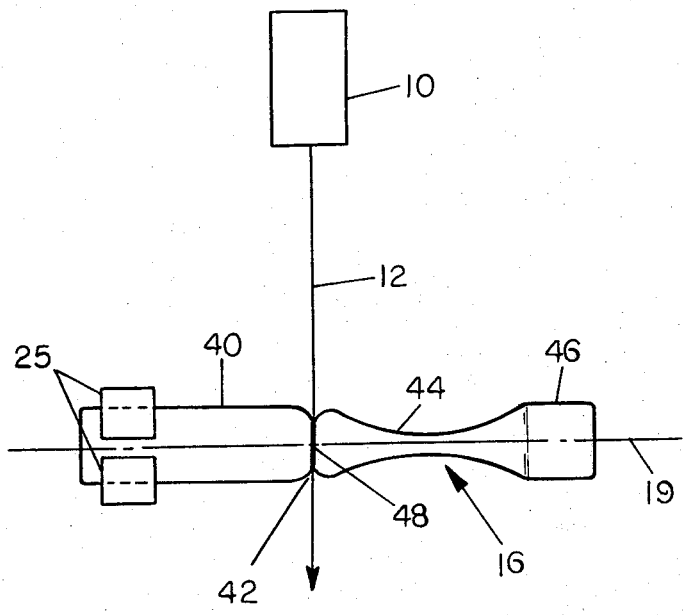
FIG. 3
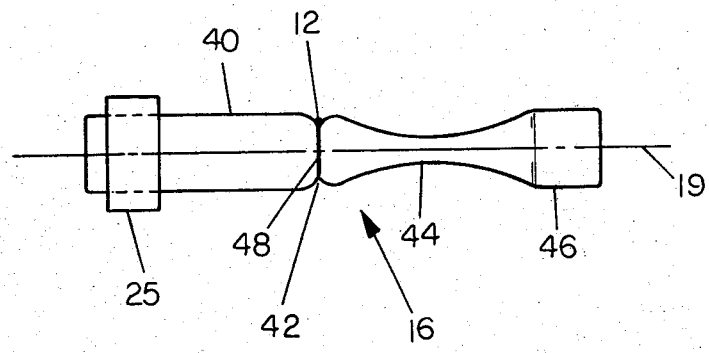
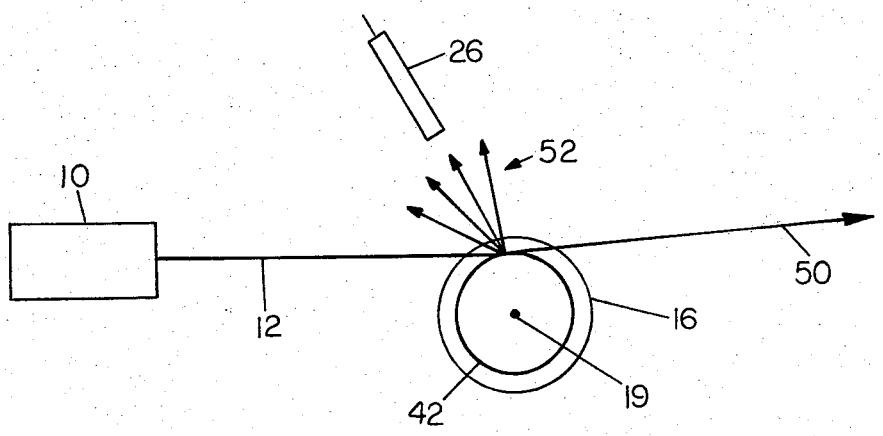
FIG. 4

AMPULE SCORE LINE DETECTION

BACKGROUND OF THE INVENTION

Glass ampules which are used as containers for pharmaceuticals are generally provided with a score line which is located on the constricted portion of the ampule. The ampule is broken at the constriction in order to remove its contents. The presence of the score line facilitates a smooth break, and the absence of a score line (or the presence of a score line which does not extend completely around the circumference of the constriction) may result in jagged edges or splinters when the ampule is broken. In order to insure the presence of a complete score line, inspection of the ampule is necessary. Previously this has been accomplished by visual inspection. Problems associated with visual inspection are those of speed and accuracy.

Several systems have utilized laser beams for the inspection of glass containers. In U.S. Pat. No. 3,302,786 a laser beam is utilized to inspect the rim of a glass container. However, detection of defects is accomplished by sensing a redirection of the laser beam when it strikes a defect, rather than the detection of diffuse versus specular reflection. In U.S. Pat. No. 3,684,385, measurement of the diminution in intensity of a laser beam as it passes through a translucent material is utilized to detect defects in the material. This is likewise not related to the type of reflection which occurs when the laser beam strikes the container surface.

Other optical inspection devices have generally utilized a redirection of a light beam to detect defects in glass containers. Examples of this are U.S. Pat. Nos. 3,880,650 (which is utilized to inspect the sealing surface of a container), 3,887,285 (which detects reflections from checks in glass containers), and 3,639,067 (which uses a fiber optic device to detect checks). These patents do not involve either the use of a laser beam or the detection of diffuse versus specularly reflected light.

SUMMARY OF THE INVENTION

A laser beam is directed towards the constricted portion of an ampule approximately tangent to the constriction. Upon striking the constriction, the laser beam is specularly reflected, primarily in the forward direction, if no score line is present on the constriction and diffusely scattered if a score line is present. By detecting a component of any diffusely scattered light and comparing it to a reference level a determination may be made as to whether or not a score line is present. The ampule is rotated so as to allow inspection of the entire circumference of the constriction in order to detect incompletely scored ampules. Defective ampules may then be automatically rejected. The inspection process may also be utilized to reject ampules which have an improperly sized constriction.

BRIEF DESCRIPTION OF THE DRAWINGS

In the drawings:

FIG. 2 is a top view of an ampule which is being inspected;

FIG. 3 is a side view of an ampule under inspection;

FIG. 4 is an end view of an ampule under inspection;

DETAILED DESCRIPTION OF THE DRAWINGS

Figure 1:
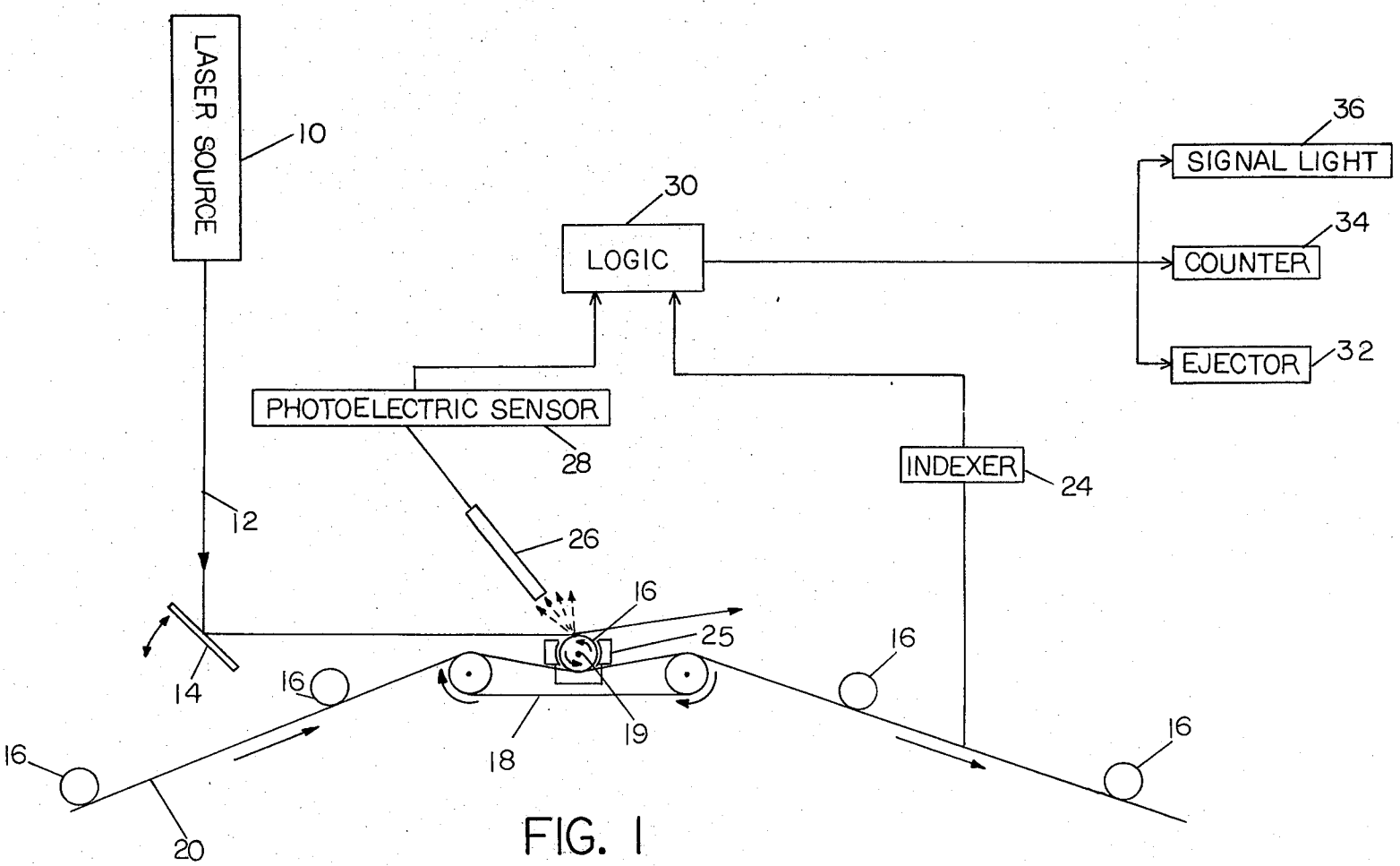
FIG. 1 is a schematic diagram of inspection apparatus for detecting improperly scored ampules.

Referring to FIG. 1, a laser generation source 10 emits a laser beam 12 which is projected towards a mirror 14. The angle between the mirror 14 and the laser beam 12 is adjustable (by changing the relative tilt of the mirror 14) so as to permit control of the direction of the laser beam 12. The laser beam 12 is reflected from the mirror 14 towards an ampule 16 having an axis 19. The ampule 16 is held in a fixed location and rotated about its axis 19 by means of a rotator belt 18. The ampule 16 is held in position by a clamp means 25 which prevents transverse motion but allows the ampule 16 to freely rotate. After inspection of one ampule 16 is completed, it is released by the clamp 25. A conveyor 20, upon which the ampules 16 are located, then moves the next ampule 16 into position for inspection. The conveyor 20 moves in an intermittent fashion. One ampule 16 at a time is moved into position by the conveyor 20, brought to a standstill, and rotated about its axis 19 for a predetermined amount of time. The conveyor 20 then moves again so as to bring the next ampule 16 into position, and the inspection process is then repeated. An indexer 24 feeds a signal which corresponds to each step of the conveyor 20 to a logic system 30 to initiate the test. An additional optical pickup (not shown) senses the presence (or absence) of an ampule 16 which is in position for inspection. A fiber optic pickup device 26 is positioned above and behind the point where the laser beam 12 strikes the ampule 16. A photoelectric sensor 28, which in the preferred embodiment is a United Detector Technology Inc. Model PIN-6D photodiode, provides a voltage output corresponding to the amount of light received by the fiber optic pickup 26 and feeds it to a logic system 30. The logic system 30, which is a basic comparator circuit as is well known in the art, compares the signal of the photoelectric sensor 28 with a reference level in order to determine whether or not the ampule 16 which is being tested is defective. If the signal from the photoelectric sensor 28 is less than the reference level (and if an ampule 16 is present as determined by the not shown optical sensor), the ampule 16 is defective and an ejector 32, a counter 34 and signal light 36 are all activated. The signal from the indexer 24 provides a timing control for the logic system 30, with one ampule 16 being inspected between successive signals from the indexer 24.

Referring now to FIGS. 2–4, the optical operation of the invention will be described. FIG. 2 shows a top view of an ampule 16 which is being inspected. The ampule 16 includes a main body portion 40, a constriction 42, a neck area 44, and a funnel portion 46. A score line 48 is located on the constriction 42. The clamp 25 contacts the main body portion 40 of the ampule 16. The laser beam 12 is projected towards the constriction 42. FIG. 3 is a side of ampule 16 during inspection with line 19 representing the longitudinal axis of the ampule 16. As shown in FIG. 4, the laser beam 12 is directed parallel to and just below a tangent to the constriction 42. If no score line 48 is present on the constriction 42, the laser beam 12 will be specularly reflected in a forward direction from the smooth glass surface, as shown by ray 50. A score line 48, however, has a rough surface which will cause the laser beam 12 to be diffusely scattered upon striking the constriction 42, as shown by rays 52. The fiber optic pickup 26 is positioned above and behind the ampule 16 at an angle between forty-five and sixty degrees with respect to the incident laser beam 12. The critical factor, however, is not the size of the angle, but rather the positioning of the fiber optic pickup 26 so as to receive a component of any light which is diffusely scattered after striking the ampule 16. Since a specularly reflected beam 50 will reflect off of the ampule 16 in a forward direction, the amount of light received by the fiber optic pickup 26 from an ampule 16 without a score line 48 will be negligible. A relatively large amount of light will be received by the fiber optic pickup 26, however, after reflection from an ampule 16 with a score line 48. A high signal to noise ratio is thus obtained due to the great difference in the angle of reflection between diffusely versus specularly reflected beams. In addition, by holding the ampule 16 stationary with the clamp 25 and rotating it so as to inspect every point on the circumference of the constriction 42, it is possible to detect ampules which have been incompletely scored (i.e. a score line 48, though present, does not extend completely around the circumference of the constriction 42).

Figure 5:
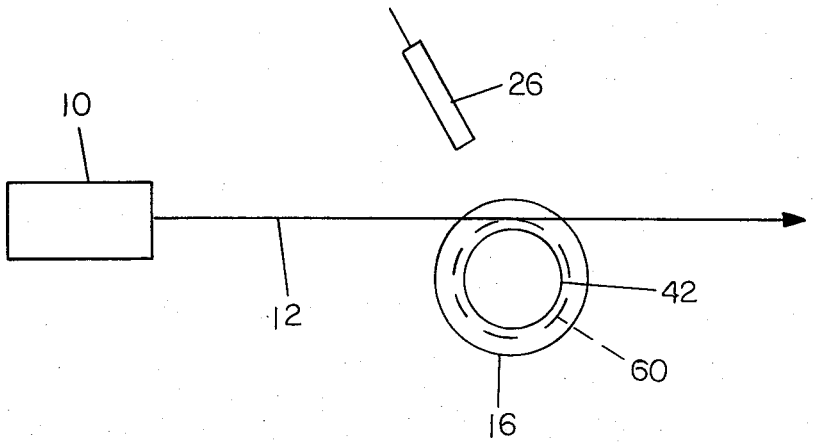
FIG. 5 is an end view of an ampule with an undersized constriction.
Figure 6:
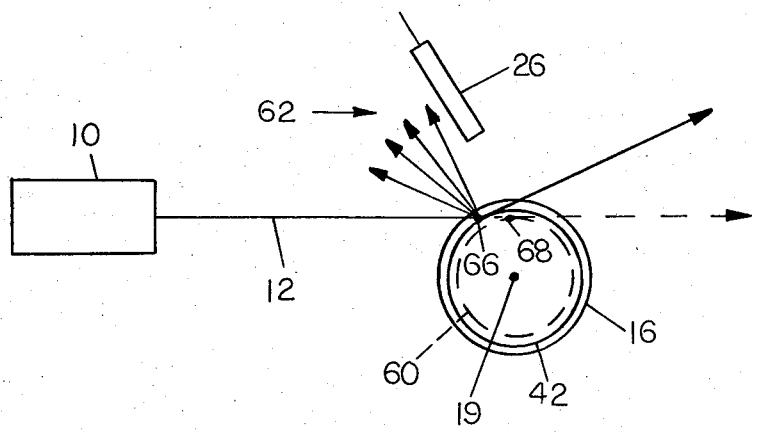
FIG. 6 is an end view of an ampule with an oversized constriction.

Referring now to FIGS. 5 and 6, the effect of undersized and oversized constrictions 42 on the inspection process will be described. A dotted line 60 shows the proper size for a constriction 42. If the constriction 42 is too small, as shown in FIG. 5, the laser beam 12 will not strike the constriction 42 at all. The fiber optic pickup 26 clearly will receive no light in this case, which is similar to the case of reflection off of a constriction 42 without a score line 48 (in which the amount of light received, though not zero, is negligible). If the constriction 42 is too large, as shown in FIG. 6, the laser beam 12 will strike it. If no score line 48 is present, the beam 12 will be specularly reflected and the fiber optic pickup 26 will receive a negligible amount of light. If a score line 48 is present, the laser beam 12 will be reflected diffusely. However, the fiber optic pickup 26 is located so as to receive reflections from the point 68 where the laser beam 12 would strike a properly sized constriction 42. In the case of an oversized constriction 42, the laser beam 12 will strike the constriction at a different point 66 which is behind point 68, and any diffuse reflection will be scattered in a way such that significantly less light will be picked up by the fiber optic pickup 26, as shown by rays 62. From the foregoing it is clear that the fiber optic pickup 26 will receive a relatively large amount of light only when a properly sized and scored ampule 16 is being inspected. The single test may thus be utilized to detect ampules 16 having improperly sized constrictions 42 as well as those without a complete score line 48.

What is claimed is:

1. A method of inspecting an ampule having a constriction to determine whether or not a diffusely reflecting score line is present on said constriction comprising the steps of:

(a) projecting a laser beam towards the constriction of said ampule, said laser beam being directed parallel to and slightly below a tangent to the constriction;

(b) determining whether the laser beam is specularly reflected or diffusely scattered after striking the constriction, with specular reflection corresponding to the absence of a score line.

2. The method of claim 1 including the step of rejecting said ampule if the laser beam is specularly reflected from it.

3. The method of claim 1 wherein step (a) includes the step of controlling the direction of said laser beam by reflecting it from an adjustable mirror towards said ampule.

4. The method of claim 1 including the step of inspecting the entire circumference of the constriction of said ampule in order to determine if a score line, though present, is incomplete.

5. The method of claim 4 including the step of rejecting said ampule if the laser beam is specularly reflected from any point on the circumference of the constriction of the ampule.

6. The method of claim 4 wherein said inspection of the entire circumference of said constriction is accomplished by rotating the ampule about its longitudinal axis as said laser beam is projected towards it so that said laser beam strikes every point on said constriction.

7. The method of claim 1 wherein step (b) is accomplished by detecting a component of any light which is diffusely scattered by means of a fiber optic pickup, said fiber optic pickup being located so as to not receive any of the laser light which is specularly reflected from said constriction.

8. The method of claim 7 including the step of converting the light output of said fiber optic pickup to a voltage output by means of a photodetector and comparing said voltage output with a predetermined reference level, said reference level corresponding to less than the amount of light detected by said fiber optic pickup after reflection from an ampule having a score line but greater than the amount of light detected by said fiber optic pickup after reflection from either an ampule without a score line or an ampule with an oversized constriction.

9. The method of claim 8 including the step of rejecting said ampule if said photodetector voltage is less than said reference level.

10. Apparatus for inspecting ampules having a constriction to determine whether or not a diffusely reflecting score line is present on said constriction comprising:

(a) a laser beam;

(b) means for directing said laser beam towards the constriction of said ampule parallel to and slightly below a tangent to said constriction; and (c) means for determining whether said laser beam is reflected specularly or diffusely after striking the constriction of said ampule, with specular reflection corresponding to the absence of a score line.

11. The apparatus of claim 10 further including means for rejecting said ampule if said laser beam is specularly reflected.

12. The apparatus of claim 10 wherein said means for directing said laser beam includes an adjustable mirror from which said laser beam is reflected prior to striking said ampule.

13. The apparatus of claim 10 wherein said means for determining whether said laser beam is reflected specularly or diffusely includes a fiber optic pickup which is positioned to receive only light which is diffusely reflected after striking said constriction.

14. The apparatus of claim 13 wherein said fiber optic pickup is positioned so as to receive light which is diffusely reflected after striking a properly sized constriction.

15. The apparatus of claim 14 further including a photodetector connected to said fiber optic pickup to convert the light received by said pickup into a corresponding voltage; and means for comparing said voltage with a reference level, said reference level being greater than a value corresponding to the amount of light received by said fiber optic pickup after reflection from an ampule without a score line or with an improperly sized constriction but less than a value corresponding to the amount of light received by said fiber optic pickup after reflection from an ampule with a score line.

16. The apparatus of claim 15 further including means for rejecting said ampule if the output of said photodetector is less than said reference level.

17. The apparatus of claim 15 further including means for inspecting the entire circumference of the constriction of said ampule and means for rejecting said ampule if said laser beam is specularly reflected from any point on the circumference of said constriction.

18. The apparatus of claim 17 wherein said means for inspecting the entire circumference of the constriction of said ampule includes means for holding said ampule in a fixed location and rotating it about its longitudinal axis, thus causing the laser beam to strike every point on the circumference of the constriction.

19. The apparatus of claim 10 further including means for inspecting the entire circumference of the constriction of said ampule.

20. The apparatus of claim 19 further including means for rejecting said ampule if said laser beam is specularly reflected from any point on the circumference of said constriction.

21. The apparatus of claim 19 wherein said means for inspecting the entire circumference of the constriction of said ampule includes means for holding said ampule in a fixed location and rotating it about its longitudinal axis, thus causing the laser beam to strike every point on the circumference of the constriction.

* * * * *